United States Patent [19]

Effinger

[11] Patent Number: 4,887,197

[45] Date of Patent: Dec. 12, 1989

[54] METHODS AND APPARATUS FOR GENERATING LIGHT PATTERNS RESPONSIVE TO AUDIO FREQUENCY INPUT SIGNALS

[75] Inventor: Mark A. Effinger, Vancouver, Wash.

[73] Assignee: O'Ryan Industries, Vancouver, Wash.

[21] Appl. No.: 188,207

[22] Filed: Apr. 29, 1988

[51] Int. Cl.[4] ..... F21V 7/00

[52] U.S. Cl. ..... 362/306; 362/86; 362/259; 362/811; 84/464 R

[58] Field of Search ..... 84/464 R; 272/8 P; 362/259, 306, 806, 811, 86

[56] References Cited

U.S. PATENT DOCUMENTS

| | | | |
|---|---|---|---|
| 3,478,837 | 11/1969 | Ross | 362/86 |
| 3,590,681 | 7/1971 | Cross | 84/464 |
| 3,603,195 | 9/1971 | Williams | 84/464 |
| 4,010,361 | 3/1977 | Latterman et al. | 362/259 X |
| 4,355,348 | 10/1982 | Williams | 362/86 |
| 4,622,881 | 11/1986 | Rand | 84/464 R |

OTHER PUBLICATIONS

Laser FX TM advertisement, "The Sharper Image," May 1988.

Laser Rhythm, brochure/price list, NM Laser Products Inc., Sunnyvale, Calif., Oct. 1987, 2 pages.

Laser Chorus, brochure/price list, Laser Chorus Inc., Austin, Tex., Jun. 24, 1987, 2 pages.

Galaxy, brochure/price list, Laser Play Inc., San Jose, Calif., 2 pages, no date given.

SummaStar, brochure/price list, Summa Technologies, Inc., San Jose, Calif., from "Lighting Dimensions," magazine, Nov. 1987, 2 pages.

Geometric Pattern Generators, "Night Club & Bar", Jan., 1988, pp. 23–24.

*Primary Examiner*—Stephen F. Husar

*Attorney, Agent, or Firm*—Marger & Johnson, Inc.

[57] ABSTRACT

Methods and apparatus are disclosed for reflecting a laser beam so that it traverses a path on a display surface defining a visible display pattern responsive to an audio frequency input signal. The input signal is provided to a speaker, and the laser beam reflects off a front surface mirror, mounted onto the speaker so that the mirror vibrates responsive to the input signal.

11 Claims, 1 Drawing Sheet

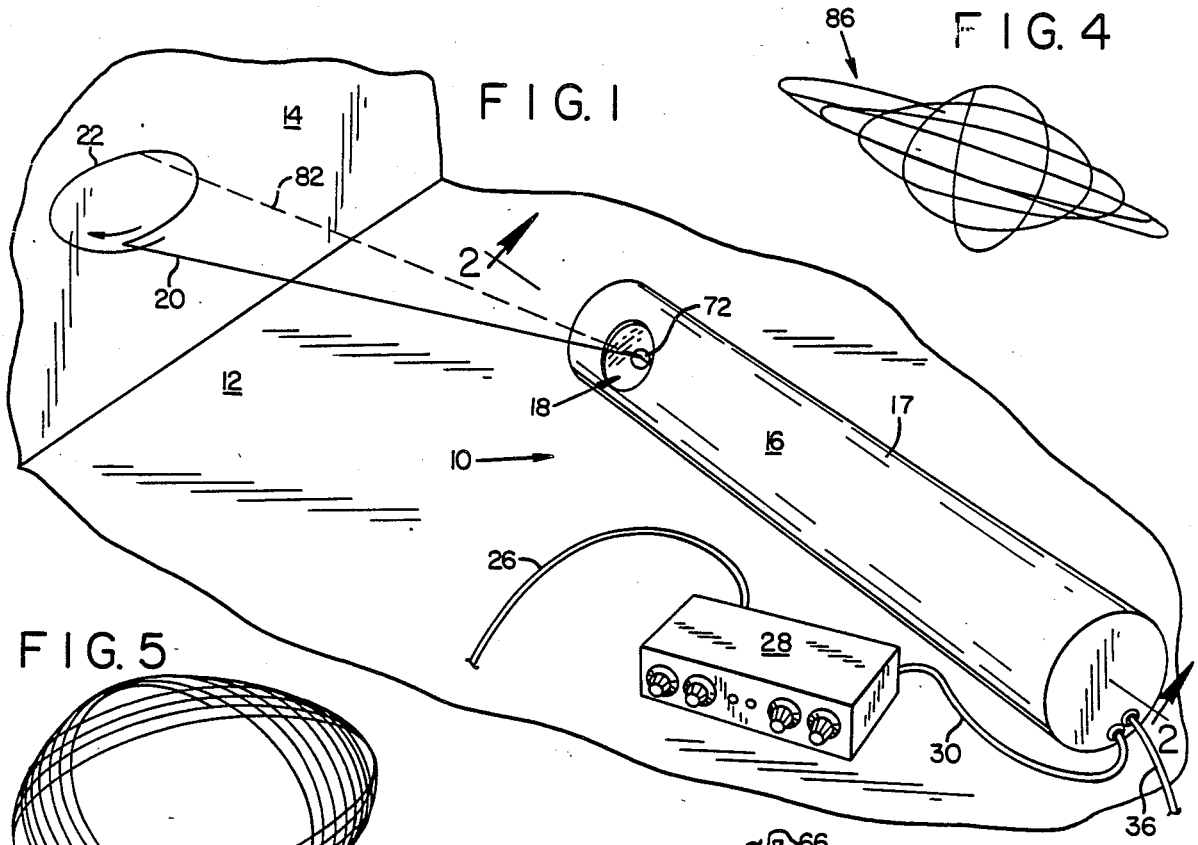
FIG. 1
14
22
82
20
2
72
12
18
17
16
10
26
28
30
2
36
86
FIG. 4
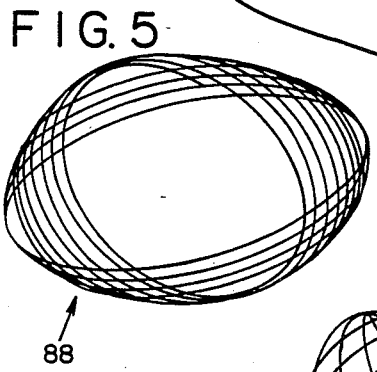
FIG. 5
88
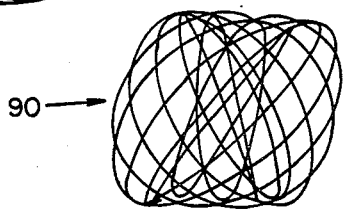
FIG. 6
90
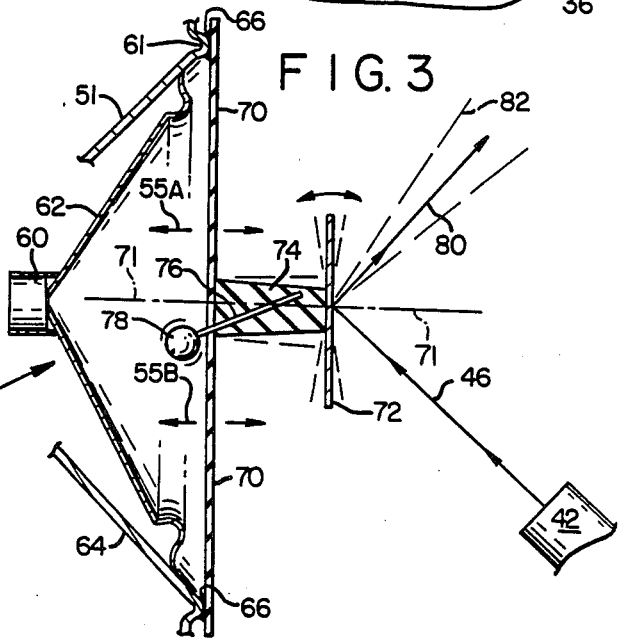
FIG. 3
66
61
51
70
82
55A
62
60
71
76
74
80
78
71
55B
46
52
72
70
42
64
66
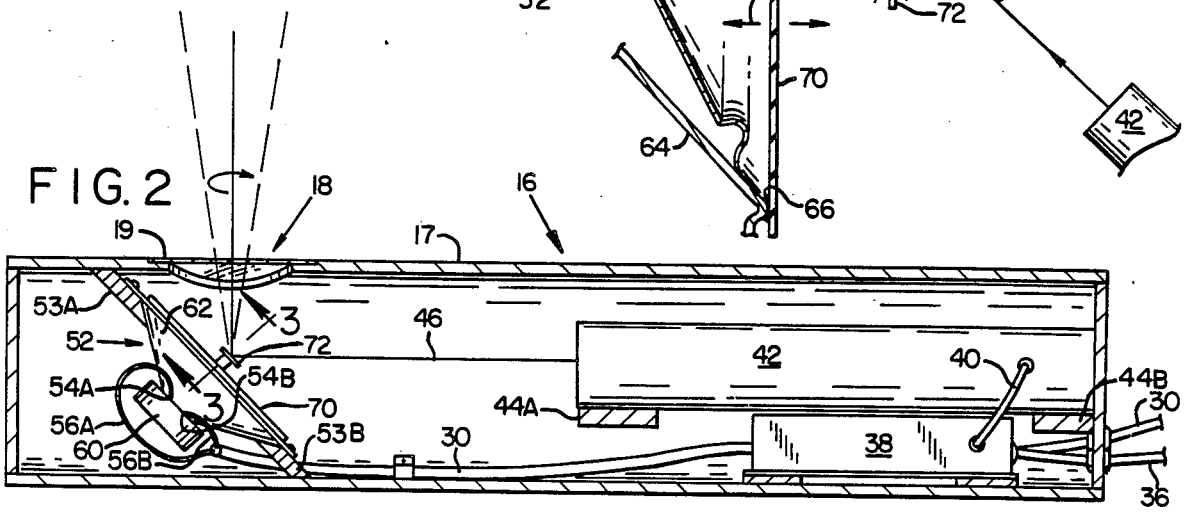
FIG. 2
18
16
19
17
53A
62
3
52
72
46
42
40
54A
54B
44B
30
3
70
44A
56A
53B
30
38
60
56B
36

METHODS AND APPARATUS FOR GENERATING LIGHT PATTERNS RESPONSIVE TO AUDIO FREQUENCY INPUT SIGNALS

BACKGROUND OF THE INVENTION

The present invention relates to the field of visual displays and more particularly to methods and apparatus for generating a visual display of light patterns responsive to an audio frequency input signal.

Visual display systems are known which employ light baffles to create compartments, and illuminate the compartments with combinations of light sources and filters for producing abstract lighting effects. Such devices thereby generate areas of light which are larger than individual bulbs, but nonetheless are discrete and stationary. Apparatus of this type are described in U.S. Pat. No. 4,622,881. Such devices are not driven by audio programming input. Rather, they are "stand alone," although their output may be coordinated with the beat of an audio program by use of a "beat detector" shown in FIG. 4 in the '881 patent.

Other known methods and apparatus for producing "light shows" include a series of band-pass filters for dividing an audio input signal into several components, each representing a particular band of frequencies. These component signals may be used to control a display unit comprising, for example, an array of light bulbs or light emitting diodes, so that each frequency component activates a particular light or group of lights. An apparatus of that type is shown in U.S. Pat. No. 4,355,348. In an apparatus of that type, the size of the visual display is equal to the size of the display unit, typically on the order of one or two feet square. Manufacture of a larger display unit employing the same techniques as shown in U.S. Pat. No. 4,355,348 would be bulky, expensive, and require a substantial amount of electrical power to operate. Whatever the size of the display unit, it comprises a number of discrete light sources, thereby limiting the size of the generated visual display.

Still other devices are known for controlling lights in a display unit responsive to the volume or power level of the audio input signal. Thus, such devices activate additional lights or different lights, as the level of the input signal varies.

Another apparatus for combining audio and visual effects is shown in U.S. Pat. No. 3,478,837. That patent shows a speaker including a rotating baffle for creating a tremolo or vibrato effect, coupled with a light bulb which is activated synchronously with the rotating baffle to produce what the inventor calls "optically enhanced vibrato." The visual aspect of that invention comprises a single flashing light bulb.

Laser lighting systems are known which employ a laser beam reflected off an orthogonal pair of mirrors onto a wall or other display surface for producing any one of a variety of predetermined display patterns. A light beam is directed so that it strikes one of the mirrors, then the other mirror, and finally a display surface. Each mirror is oscillated by an independent transducer including a magnet and drive coil. A pair of signal generators drive the coils. The apparatus includes a memory containing prestored driver information for controlling the signal generators. In operation, each mirror deflects the light beam in a different direction, resulting in a two-dimensional visual display pattern. Display systems of that type are difficult to manufacture, expensive, and require substantial input signal power to drive the coils. Further, the amount of mirror deflection, and hence the size of the display pattern, is quite limited.

Laser lighting systems of the foregoing type generally are responsive to a selected characteristic of an audio input signal. For example, changes in input signal volume and/or frequency are used to select among predetermined display patterns. Thus, the particular patterns selected for display and their sequence of display are determined by the audio signal, though each of the individual patterns is predetermined and information to generate it is prestored in the memory. Variations of the above-described types of equipment include multiple beam systems and systems having beam splitters for projecting repetitive images.

Display devices are also known that change display patterns automatically as a function of time, or in response to selected characteristics of an audio signal, as described above. The display pattern size may be modulated apparently responsive to the audio input by displaying progressively larger prestored patterns in response to higher audio input signal levels. In all of the above-described devices, the generated visual displays comprise one or more stationary light sources, or a light beam directed to traverse a predetermined path for displaying a predetermined pattern.

In summary, many existing devices for producing visual displays in combination with audio signals are adapted to activate stationary, discrete light sources responsive to predetermined parameters of the audio input. Other devices employ electronic circuitry including driver coils and a memory for deflecting a pair of mirrors to direct a reflected light beam to trace predetermined display patterns. Patterns are selected in response to frequency and/or volume characteristics of the audio input signal.

The need remains for a display system for generating novel light patterns traversed on a display surface in response to an audio input signal which are uniquely associated with the input signal.

SUMMARY OF THE INVENTION

The present invention is a display system and method for deflecting a light beam so that it traverses a path on a display surface defining a display pattern responsive to an audio frequency input signal. A laser display system according to the present invention includes a laser tube and associated power supply for emitting a laser light beam along a predetermined beam axis.

A mirror is positioned along the beam axis so that the light beam strikes the front of the mirror. The mirror is angled with respect to the light beam to direct the reflected beam out of the system generally toward the display surface. A speaker, responsive to an audio frequency input signal, is electrically connected to receive the input signals. The speaker is coupled to the mirror for deflecting it in two dimensions so that the reflected beam traverses a path on the display surface defining a two-dimensional display pattern responsive to the audio signal.

The mirror is mounted on a flexible diaphragm formed of a gas impermeable polymeric film. The diaphragm is acoustically coupled to the speaker, preferably positioned such that it covers the mouth of the speaker, so that the diaphragm vibrates in response to actuation of the speaker by the audio input signal. The mirror is connected atop an elongate pedestal adhered at its bottom end to the front of the diaphragm. The mirror is thereby spaced apart from the diaphragm to afford it freedom of motion in two-dimensions transversely of the diaphragm.

A weight is connected to the pedestal at the back of the diaphragm (on the speaker side), preferably by a pin, the pin positioned to protrude through the diaphragm and lodge in the pedestal. The center of gravity of the weight-pin-pedestal-mirror combination is offset from the center of the diaphragm.

In a preferred embodiment, the pedestal and mirror are positioned substantially in the center of the diaphragm. The pin is skewed with respect to the speaker axis to offset the combined center of mass from the center of the diaphragm. The particulars of the speaker, diaphragm, weight, pin, pedestal and mirror and their mutual arrangement define a resonant frequency of the display system.

In operation, an audio input signal actuates the speaker, thereby applying air pressure to the back of the diaphragm. The mirror and associated structures do not vibrate along the speaker axis because their collective center of mass is offset from the diaphragm center. Rather, they pivot about their axis, and thereby translate the axial displacement to angular displacement in two dimensions. As a result, a single periodic waveform input to the speaker having a frequency substantially equal to the resonant frequency causes the reflected light beam to traverse a path on the display surface defining substantially a circular display pattern. Variation of the input waveform frequency about the resonant frequency causes the display pattern to elongate into an ellipse and the ellipse to rotate. Complex input signals, for example music, result in various display patterns, generally of an oscillatory nature. The display patterns are particularly responsive to low audio frequencies, for example in the range of 20 to 200 hertz.

The foregoing and other objects, features and advantages of the invention will become more readily apparent from the following detailed description of a preferred embodiment which proceeds with reference to the drawings.

BRIEF DESCRIPTION OF THE DRAWING

FIG. 1 is a perspective view of a laser display system in operation according to the present invention.

FIG. 2 is a cross-sectional side view taken through the housing along line 2—2 of FIG. 1.

FIG. 3 is an enlarged, partial cross-sectional view of the reflecting apparatus of the display system of FIG. 1, taken along line 3—3 of FIG. 2.

FIG. 4 is a first illustrative display pattern traversed by the laser beam generated by the display system of FIG. 1.

FIG. 5 is a second illustrative display pattern generated by the display system of FIG. 1.

FIG. 6 is a third illustrative display pattern generated by the display system of FIG. 1.

DETAILED DESCRIPTION

A laser display system 10 is shown in FIG. 1 in operation. It emits a beam of light 20 and directs the beam so that it traverses a path 22 on a display surface 14, defining a display pattern responsive to an audio input. The display system 10 includes a main unit 16 in an elongate housing 17 and, optionally, an amplifier unit 28. The system is positioned on a floor, table top or other support surface 12 such that the emitted light beam, described below, is directed toward a wall or other appropriate display surface 14. The light beam may be directed to a ceiling or any other surface or object. The display surface need not be flat, though a flat surface better displays the symmetry of the displayed patterns. The main unit 16 may also be clamped to a supporting structure, as is done in theatre lighting, or otherwise firmly mounted in any convenient position and location.

The amplifier nit 28 is a conventional audio amplifier. It may be connected to an output of an audio generating device, such as a receiver, compact disk player, tape player, phonograph and the like. It is preferable to employ an amplifier 28 where the output level (input to the display system) is very low, for example, where the signal is provided by a tape deck or turntable output (sometimes labeled "line output") intended for amplification in order to drive a speaker. The output level of the amplifier 28 may be varied to vary the size of the display patterns.

When an amplifier 28 is used, the output from the audio generating device is provided over a wire 26 to the amplifier 28. The amplified audio signal is connected from the audio amplifier 28 output via cable 30 to the main unit 16. The amplifier may be omitted where the audio input signal is a higher level, for example, that provided by a speaker output from a receiver, or audio amplifier.

The main unit 16 is shown partially in cross section in FIG. 2. The main unit is enclosed in a rigid housing 17. The housing 17 includes an aperture 18 in one side for emitting the light beam. The aperture 18 is covered by a transparent window 19, for example, made of a polymeric material or glass. The housing 17 may be cylindrical, although its specific shape is unimportant.

A laser generating tube 42 is rigidly mounted inside the housing 17, for example, on a pair of mounting posts 44A and 44B. The laser tube 42 is a conventional, low power laser beam generating device. Such devices are available in several colors including red, green, yellow and orange. The laser preferably is a helium neon type laser, producing a beam output power in the range of about 1 milliwatt to 10 milliwatts. Current government regulations allow a maximum of 5 milliwatts for operation without an FDA variance.

A high voltage power supply 38 also is mounted inside the housing 17 for energizing the laser tube 42 via conductor 40. The power supply 38 also is rigidly mounted inside the housing 17, preferably adjacent to laser tube 42 to minimize emission of electrical noise. The power supply is powered by a line cord 36 which is plugged into an ordinary household electrical outlet. The other components in the main unit are powered by the audio signal. When activated, the laser tube emits a laser light beam along beam axis 46.

Referring now to FIG. 3, a conventional audio speaker 52, preferably a three inch diameter woofer, is mounted toward the end of the housing 17 opposite the laser tube 42. The speaker defines a speaker axis 71. The speaker is positioned such that a mirror 72, described below, is positioned along beam axis 46. The speaker includes a conventional permanent magnet driver 60. The audio input signal is provided to the main unit 16 via cable 30. Cable 30 includes a pair of conductors 56A and 56B (FIG. 2). These are connected to input terminals 54A and 54B, respectively on the speaker 52.

A diaphragm 70 is stretched taut as further described below and fixed in position around the outer periphery 61 of speaker frame 51 so that it covers the mouth of the speaker.

Diaphragm 70 is formed of a thin, substantially gas impermeable film of a flexible polymeric material, preferably 0.006 inch thick latex rubber. The diaphragm has a front side, facing away from the speaker, and a back side, facing towards the speaker.

A flat front-surface mirror 72 is connected to the diaphragm 70. The mirror 72 is mounted spaced apart from the diaphragm 70 by an extension or pedestal 74. Preferably, the pedestal 74 is made of a resilient material such as silicone. The pedestal is adhered at its bottom end to the front side of the diaphragm, preferably at the center of the diaphragm. The back side of the mirror 72 is adhered to the top end of the pedestal 74. The mirror is spaced a distance from the diaphragm sufficient to allow the mirror wide freedom of motion in two dimensions. In a preferred embodiment, the mirror can pivot as much as ±35–40° off the speaker axis. Were the mirror attached directly to the diaphragm, it could not pivot to that extent. Second, spacing the mirror above the diaphragm amplifies the angular displacement of the speaker responsive to displacement of the diaphragm.

A weight 78 is connected to the back side of the diaphragm, positioned offset from the center of the diaphragm and spaced axially slightly apart from the diaphragm. The weight conveniently is fixed to one end of a metal pin 76. The other end of the pin 76 extends through the diaphragm 70 and protrudes into the pedestal 74. The weight may consist of a bead of solder, affixed to the pin. The pin is inserted into the base of the pedestal at an angle so that the weight is offset from the center of the diaphragm.

The speaker is rigidly mounted in the housing 17 with diaphragm 70 and mirror 72 oriented at a 45° angle to the beam axis 46 and the mirror aligned with window 18.

In one example of a display system 10, the speaker 52 is a 3— woofer having 8 ohms impedance. The diaphragm 70 is formed of a 0.006"–0.008" thick sheet of latex rubber, such as that sold by McMaster Carr. The weight is a bead of lead solder about 2–4 mm in diameter The pin is a thin, steel pin about 6–8 mm long. The pedestal is substantially cylindrical or conical, formed of silicone, and measures about 6–9 mm in height and about 10 mm in diameter at its base. The mirror is a flat, round, front-surface mirror about 18 mm in diameter and 0.2 mm thick. This configuration has been shown to produce display patterns measuring 8 feet across on a display surface spaced 5 feet from the display system.

In operation, the laser tube 42 is activated to emit a light beam 46 directed toward the mirror 72. The speaker is actuated by an audio input signal provided over the cable 30 from the amplifier 28. The speaker cone 62 vibrates in the conventional manner in response to the audio input signal, perturbing the air between the speaker cone 62 and the diaphragm 70, thereby distending the diaphragm 70 generally in the direction of the speaker axis 71, indicated by arrows 55A and 55B, to form vibrations of the diaphragm.

The offset of the weight 78 from the center of the diaphragm positions the center of mass of the reflecting structures, comprising the weight, diaphragm, pedestal and mirror, offset from the center of the diaphragm. As a result, the reflecting structures respond to the vibrations in an asymmetric manner with respect to the speaker axis. The mirror is deflected angularly with respect to the speaker axis, and pivots rotationally about a center of rotation. The reflected beam accordingly traverses a path on the display surface defining a display pattern comprising a series of generally elliptical figures.

ASSEMBLY

One method of manufacturing the display apparatus includes tuning it in the following manner. The mirror 72, pedestal 74, pin 76, and weight 78 are assembled and adhered to the diaphragm 70, which is not yet connected to the speaker 52. A bead of adhesive 66 is applied to the speaker frame 51 around the perimeter of the circle defined by the other periphery of the speaker cone 62. The diaphragm 70, is stretched over the speaker frame 51, extending beyond the periphery of the speaker, and positioned so that the pedestal is substantially centered with respect to the speaker.

A test laser light beam is directed to the mirror 72 so that the beam reflects onto a display surface. A substantially pure sign wave test signal having a low audio frequency, for example in the range of about 50–100 hertz, is provided to the inputs of the speaker 52. The diaphragm 70 is then tensioned radially at various points around the periphery of the speaker, until the light pattern displayed in response to the test signal is substantially a circle.

The display system now has a resonant frequency equal to the test signal frequency. The tension on the diaphragm also is adjusted to optimize efficiency, i.e., to maximize the size of the display pattern without undue distortion. For example, if the diaphragm were stretched too taut, it would vibrate only slightly in response to a given audio power level supply to the speaker, thereby resulting in a display pattern of relatively small size. On the other hand, if the diaphragm were too loose, it would be less responsive. The resulting display pattern would be slow moving and subject to distortion, producing a display that was irregular rather than symmetric. When the diaphragm 70 is stretched over the speaker properly and to an appropriate tension, the display responsive to a pure sign wave at the resonant frequency is substantially circular.

When the test signal has a frequency off of the resonant frequency of the display system, the resulting display is an oval. Varying the input frequency causes the aspect ratio of the displayed figure to vary, as well as its orientation, resulting in a display pattern 88 as shown in FIG. 5. FIG. 6 shows a display pattern 90 which is generated in response to an audio input signal comprising more than one sign wave. Another illustrative display pattern 86 is shown in FIG. 4.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A display system for generating a visible pattern on a display surface responsive to an audio frequency input signal, comprising:

means for emitting a visible beam of light along a predetermined beam axis;

reflecting means interposed along the beam axis for reflecting the light beam to form a reflected beam directed generally toward the display surface;

oscillating means, including a speaker, responsive to the audio frequency input signal for oscillating the reflecting means to generate a pattern on the display surface;

the oscillating means further including a flexible diaphragm acoustically coupled to the speaker so that the diaphragm distends in response to actuation of the speaker by the input signal and including means for mounting the reflecting means on the diaphragm so as to move the reflecting means angularly in response to distension of the diaphragm;

the mounting means further including pedestal means connected to the front side of the diaphragm for supporting the reflecting means spaced apart from the diaphragm to amplify said motion of the reflecting means in response to distension of the diaphragm; and the pedestal means including a generally cylindrical pedestal formed of a pliable silicone material having a top end and a bottom end, connected at the bottom end to the diaphragm and connected at the top end to the back of the reflecting means, for maintaining the reflecting means spaced apart from the diaphragm and in substantially parallel relation to the diaphragm.

2. A display system according to claim 1 wherein the diaphragm is tensioned such that, in response to a sinusoidal input signal of a predetermined low audio frequency, the reflecting means oscillates at the predetermined frequency, whereby the pattern generated on the display surface is substantially circular.

3. A display system for generating a visible pattern on a display surface responsive to an audio frequency input signal, comprising:

means for emitting a visible beam of light along a predetermined beam axis;

reflecting means interposed along the beam axis for reflecting the light beam to form a reflected beam directed generally toward the display surface; and oscillating means, including a speaker, responsive to the audio frequency input signal for oscillating the reflecting means to generate a pattern on the display surface;

the oscillating means further including a flexible diaphragm acoustically coupled to the speaker so that the diaphragm distends in response to actuation of the speaker by the input signal and including means for mounting the reflecting means on the diaphragm so as to move the reflecting means angularly in response to distension of the diaphragm;

the reflecting means and mounting means being substantially centered on the diaphragm and the mounting means further including a weight connected to the back side of the diaphragm in a position offset from the center of the diaphragm.

4. The display system of claim 3 wherein the mounting means further includes a pin lodged in the pedestal adjacent the back of the mirror; and the weight is connected to the pin.

5. The display system of claim 4 wherein the diaphragm is made of a stretched polymeric material; and the weight, pin, pedestal and mirror sized and positioned relative to one another so that the mirror is balanced in a position substantially parallel to the diaphragm.

6. An apparatus for use in combination with a light source and an audio signal for generating a visual display pattern responsive to the audio signal, comprising:

a mirror positioned for reflecting the beam to form a reflected beam;

a speaker responsive to the audio signal;

a flexible diaphragm acoustically coupled to the speaker to vibrate; and mounting means for mounting the mirror to the diaphragm so as to translate vibration of the diaphragm from an axis normal to the diaphragm to angular movement of the mirror in two dimensions normal to said axis, thereby directing the reflected beam to traverse a course defining the display pattern responsive to the audio signal;

the mounting means including a pedestal positioned between the diaphragm and the mirror for spacing the mirror apart from the diaphragm so that the mirror can move through an angular range in said two dimensions relative to the diaphragm and thereby amplify the size of the display pattern and including a weight connected to the pedestal on the side of the diaphragm opposite the pedestal;

the pedestal and the mirror being substantially centered on the diaphragm axis and the weight being offset from the diaphragm axis.

7. The apparatus of claim 6 in which the angular range is at least $\pm 35°$.

8. The apparatus of claim 6 wherein:

the pedestal is mounted substantially in the center of the diaphragm; and the diaphragm has a predetermined tension relative to the masses of the mirror and weight, thereby determining a resonant frequency of the apparatus so that, responsive to an input signal consisting of a regular, periodic waveform having a frequency substantially equal to the resonant frequency of the apparatus, the reflected beam traverses a substantially circular path.

9. The apparatus of claim 8 wherein:

responsive to an input signal consisting of a regular, periodic waveform having a frequency other than the resonant frequency; and the reflected beam traverses a substantially elliptical path.

10. A method of generating a visual display on a display surface responsive to an audio frequency input signal comprising the steps of:

directing a light beam along a predetermined beam axis;

providing a speaker responsive to the input signal for emitting an audible signal;

mounting a diaphragm over the speaker so that the diaphragm distends responsive to actuating the speaker with the input signal;

providing a mirror for reflecting the light beam to form a reflected beam directed generally toward the display surface;

connecting the mirror to the diaphragm so that the mirror oscillates responsive to distension of the diaphragm;

weighting the mirror to offset its center of gravity; and actuating the speaker with the input signal so that the reflected beam traverses a path on the display surface.

11. A method according to claim 10 wherein mounting the diaphragm includes providing a predetermined test input signal to the speaker and tensioning the diaphragm radially about the periphery of the speaker so that the reflected beam traverses a predetermined path on the display surface responsive to the test input signal.

* * * * *

UNITED STATES PATENT AND TRADEMARK OFFICE

CERTIFICATE OF CORRECTION

PATENT NO. : 4,887,197

DATED : December 12, 1989

INVENTOR(S) : Mark Effinger

It is certified that error appears in the above-identified patent and that said Letters Patent is hereby corrected as shown below:

Column 4, line 9, change "nit" to --unit--;

Column 5 line 39, change "3-" to --3"--;

line 43, insert a period after "ter".

Signed and Sealed this

Twenty-eighth Day of May, 1991

*Attest:*

HARRY F. MANBECK, JR.

*Attesting Officer*

*Commissioner of Patents and Trademarks*